US012404125B2

(12) United States Patent
Okawa et al.

(10) Patent No.: US 12,404,125 B2
(45) Date of Patent: Sep. 2, 2025

(54) MEDIUM CONVEYING DEVICE

(71) Applicant: SEIKO EPSON CORPORATION, Tokyo (JP)

(72) Inventors: Soshi Okawa, Shiojiri (JP); Dai Tamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 65 days.

(21) Appl. No.: 18/413,111

(22) Filed: Jan. 16, 2024

(65) Prior Publication Data

US 2024/0239623 A1 Jul. 18, 2024

(30) Foreign Application Priority Data

Jan. 18, 2023 (JP) ..... 2023-005562

(51) Int. Cl.
*B65H 3/06* (2006.01)
*B65H 7/18* (2006.01)

(52) U.S. Cl.
CPC ..... *B65H 3/0669* (2013.01); *B65H 3/0684* (2013.01); *B65H 7/18* (2013.01); *B65H 2403/72* (2013.01); *B65H 2513/10* (2013.01)

(58) Field of Classification Search
CPC ..... B65H 3/06; B65H 3/0669; B65H 3/0684; B65H 3/5215; B65H 3/5261; B65H 7/18; B65H 2403/72; B65H 2403/722; B65H 2513/10
See application file for complete search history.

(56) References Cited

U.S. PATENT DOCUMENTS 9,550,642 B1 * 1/2017 Nishioka ..... B65H 5/06
2016/0091853 A1 * 3/2016 Ishikura ..... B65H 3/0684 271/3.18
2017/0247212 A1 * 8/2017 Uohashi ..... B65H 5/066
2018/0273331 A1 * 9/2018 Jariabka ..... B65H 29/20

FOREIGN PATENT DOCUMENTS

JP 2015-013717 A 1/2015

* cited by examiner

*Primary Examiner* — Prasad V Gokhale
(74) *Attorney, Agent, or Firm* — WORKMAN NYDEGGER

(57) ABSTRACT

A medium conveying device includes an accommodation unit that accommodates a plurality of media including a first medium and a second medium, a pickup roller, a retard roller, a separation roller, a conveyance roller, a drive source that generates power to rotate the rollers, a power transmission mechanism that transmits power to the pickup roller and the separation roller, and a transmission interruption mechanism that interrupts transmission of power to the pickup roller during transmission of power to the separation roller. The transmission interruption mechanism is configured to interrupt the transmission of power to the pickup roller after the pickup roller conveys the trailing end of the first medium in a conveying direction.

8 Claims, 15 Drawing Sheets

MEDIUM CONVEYING DEVICE

The present application is based on, and claims priority from JP Application Serial Number 2023-005562, filed Jan. 18, 2023, the disclosure of which is hereby incorporated by reference herein in its entirety.

BACKGROUND

1. Technical Field

The present disclosure relates to a medium conveying device.

2. Related Art

Medium conveying devices having various configurations such as a recording device typified by a printer have been used. Among them, there is a medium conveying device configured to continuously convey a plurality of media. For example, JP-A-2015-13717 discloses an image forming apparatus that includes a pickup roller, a separation roller, a retard roller paired with the separation roller, and an intermediate roller and is configured to continuously convey a plurality of sheets.

However, in a medium conveying device configured to continuously convey a plurality of media, when a second medium is conveyed following a first medium among the plurality of media, the media may not be appropriately conveyed. For example, in a medium conveying device including a pickup roller, a separation roller, a retard roller, and a conveyance roller, such as the pickup roller, the separation roller, the retard roller, and the intermediate roller of the image forming apparatus disclosed in JP-A-2015-13717, the following may occur. When the second medium is conveyed following the first medium, the second medium is conveyed by the pickup roller before the trailing end of the first medium in the conveying direction passes through the nip point between the separation roller and the retard roller, and the second medium is conveyed by the pickup roller from the upstream side in the conveying direction in a state in which the leading end of the second medium abuts on the retard roller.

SUMMARY

In order to solve the above problem, a medium conveying device according to the present disclosure includes an accommodation unit that accommodates a plurality of media including a first medium and a second medium conveyed subsequently to the first medium, a pickup roller that conveys, downstream in a conveying direction, a medium accommodated in the accommodation unit, a retard roller that is provided downstream of the pickup roller in the conveying direction and separates the medium conveyed by the pickup roller, a separation roller that abuts on the retard roller and conveys a medium to downstream in the conveying direction, a conveyance roller that is provided downstream of the separation roller in the conveying direction and conveys a medium downstream in the conveying direction, a drive source that generates power for rotating the pickup roller, the separation roller, and the conveyance roller, a power transmission mechanism that transmits the power to the pickup roller and the separation roller, and a transmission interruption mechanism that is provided in the power transmission mechanism and interrupts transmission of the power to the pickup roller during transmission of the power to the separation roller. The transmission interruption mechanism is configured to interrupt the transmission of the power to the pickup roller after the pickup roller conveys a trailing end of the first medium in the conveying direction.

DESCRIPTION OF EMBODIMENTS

Figure 1:
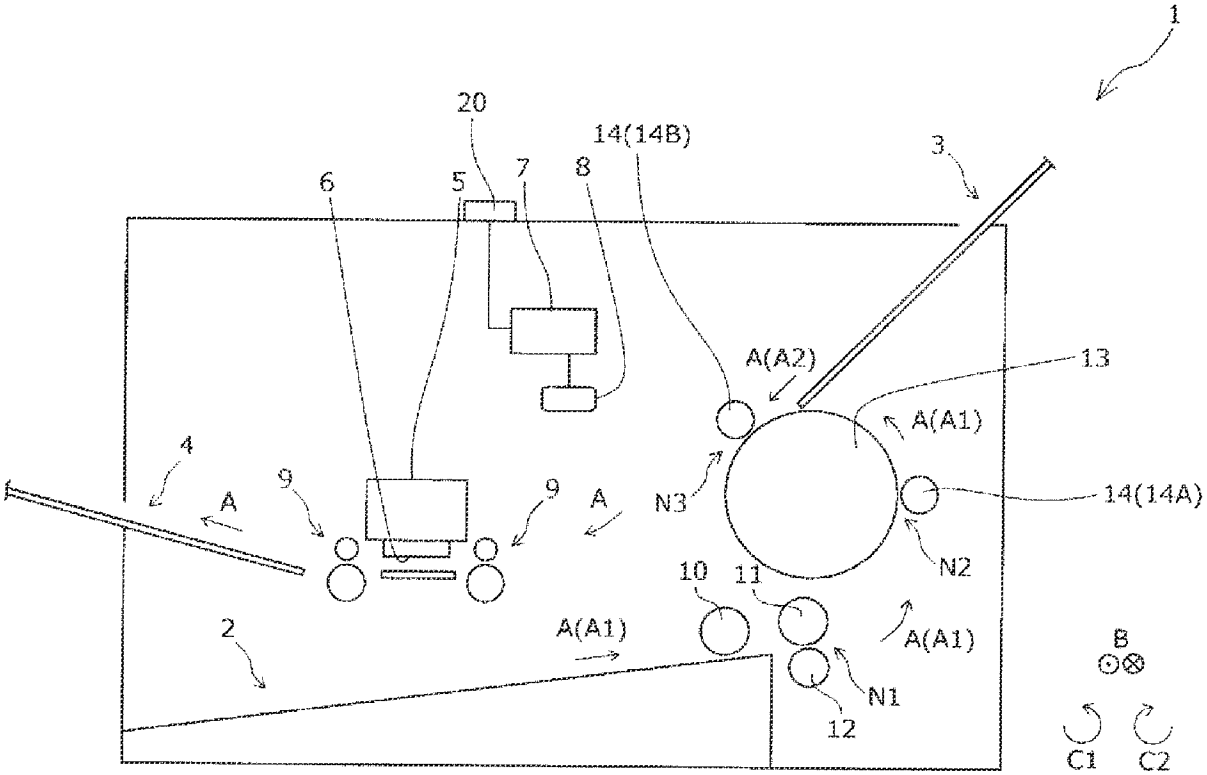
FIG. 1 is a schematic view illustrating the internal configuration of a printer according to an embodiment of the present disclosure.

Hereinafter, the present disclosure will be schematically described.

A medium conveying device according to a first aspect of the present disclosure includes an accommodation unit that accommodates a plurality of media including a first medium and a second medium conveyed subsequently to the first medium, a pickup roller that conveys, downstream in a conveying direction, a medium accommodated in the accommodation unit, a retard roller that is provided downstream of the pickup roller in the conveying direction and separates the medium conveyed by the pickup roller, a separation roller that abuts on the retard roller and conveys a medium downstream in the conveying direction, a conveyance roller that is provided downstream of the separation roller in the conveying direction and conveys a medium downstream in the conveying direction, a drive source that generates power for rotating the pickup roller, the separation roller, and the conveyance roller, a power transmission mechanism that transmits the power to the pickup roller and the separation roller, and a transmission interruption mechanism that is provided in the power transmission mechanism and interrupts transmission of the power to the pickup roller during transmission of the power to the separation roller. The transmission interruption mechanism is configured to interrupt the transmission of the power to the pickup roller after the pickup roller conveys a trailing end of the first medium in the conveying direction.

According to the present aspect, the medium conveying device includes the transmission interruption mechanism that interrupts the transmission of power to the pickup roller during the transmission of the power to the separation roller, and the transmission interruption mechanism is configured to interrupt the transmission of the power to the pickup roller after the pickup roller conveys the trailing end of the first medium in the conveying direction. Accordingly, also in the medium conveying device including the pickup roller, the separation roller, the retard roller, and the conveyance roller, when the second medium is conveyed following the first medium, the second medium can be prevented from being conveyed by the pickup roller before the trailing end of the first medium in the conveying direction passes through the nip point between the separation roller and the retard roller, and the second medium can be effectively prevented from causing jamming near the nip point between the separation roller and the retard roller. Therefore, it is possible to improve conveyance performance when the second medium is conveyed following the first medium.

The medium conveying device according to a second aspect of the present disclosure is an aspect dependent on the first aspect, and the transmission interruption mechanism is configured to interrupt the transmission of the power to the pickup roller until the separation roller conveys the trailing end of the first medium.

According to the present aspect, the transmission interruption mechanism is configured to interrupt the transmission of power to the pickup roller until the separation roller conveys the trailing end of the first medium. Since the succeeding second medium can be conveyed by the pickup roller after the preceding first medium reliably passes through the nip point between the separation roller and the retard roller, it is possible to particularly effectively prevent the second medium from causing jamming near the nip point between the separation roller and the retard roller.

In a medium conveying device according to a third aspect of the present disclosure is an aspect dependent on the first or second aspect, the pickup roller includes an abutment portion, and the transmission interruption mechanism includes a rotating member that is provided at a rotating shaft of the pickup roller, is configured to rotate in a first rotating direction that is a rotating direction when a medium is conveyed with respect to the rotating shaft, and includes an abutted portion configured to abut on and separate from the abutment portion and is configured to interrupt transmission of the power to the pickup roller while the rotating member rotates in the first rotating direction so as to be displaced from a state in which the abutted portion is separated from the abutment portion to a state in which the abutted portion abuts on the abutment portion.

According to the present aspect, the transmission interruption mechanism interrupts the transmission of the power to the pickup roller while the rotating member rotates in the first rotation direction so as to be displaced from a state in which the abutted portion is separated from the abutment portion to a state in which the abutted portion abuts on the abutment portion. With such a configuration, the transmission interruption mechanism can be easily formed compact.

In a medium conveying device according to a fourth aspect of the present disclosure is an aspect dependent on the third aspect, a first conveyance speed at which the medium is conveyed by the conveyance roller by driving the drive source is faster than a second conveyance speed at which the medium is conveyed by the pickup roller by driving the drive source, and when the medium is conveyed by both the conveyance roller and the pickup roller by driving the drive source, the medium is conveyed at the first conveyance speed, and the pickup roller receives a force from the medium as the medium is conveyed at the first conveyance speed so as to displace the rotating member from a state in which the abutted portion abuts on the abutment portion to a state in which the abutted portion is separated from the abutment portion.

According to the present aspect, when a medium is conveyed by both the conveyance roller and the pickup roller by driving the drive source, the medium is conveyed at the first conveyance speed, and the pickup roller receives a force from the medium as the medium is conveyed at the first conveyance speed, so that the rotating member is displaced from the state in which the abutted portion abuts on the abutment portion to the state in which the abutted portion is separated from the abutment portion. For this reason, it is possible to efficiently generate the time for waiting for the conveyance of the second medium when the second medium is conveyed following the first medium every time a medium is conveyed in the transmission interruption mechanism.

A medium conveying device according to a fifth aspect of the present disclosure is an aspect dependent on the fourth aspect includes a reception unit that receives an instruction to convey a medium. The pickup roller is configured to rotate in the first rotating direction by the abutted portion in a state of abutting on the abutment portion after completion of execution of the conveyance instruction received by the reception unit.

According to the present aspect, after the execution of the conveyance instruction received by the reception unit is completed, the abutted portion is made to abut on the abutment portion to set the pickup roller in a state in which the pickup roller can be rotated in the first rotating direction. For this reason, it is possible to suppress the delay of the start of the conveyance by the pickup roller when the reception unit receives the next conveyance instruction every time the reception unit receives a conveyance instruction.

A medium conveying device according to a sixth aspect of the present disclosure is an aspect dependent on the fifth aspect is configured to continue the rotation of the pickup roller by driving the drive source after the trailing end of a last medium to be conveyed passes through a position at which conveyance can be performed by the pickup roller after completion of execution of the conveyance instruction received by the reception unit.

According to the present aspect, after completion of execution of the conveyance instruction received by the reception unit, the rotation of the pickup roller is continued by driving the drive source after the trailing end of the last medium to be conveyed passes the position at which conveyance can be performed by the pickup roller. Accordingly, with a simple configuration and simple control, it is possible to prevent the pickup roller from delaying the start of conveyance when the reception unit receives the next conveyance instruction every time the reception unit receives a conveyance instruction.

In a medium conveying device according to a seventh aspect of the present disclosure is an aspect dependent on any one of the first to sixth aspects, $L1/X \leq L2-L2/X$ . . . (1), where L1/X is an interruption distance of the pickup roller generated by the transmission interruption mechanism necessary when a conveyance distance between the pickup roller and the separation roller is L1, a peripheral speed of the conveyance roller obtained by driving the drive source is X1, a peripheral speed of the pickup roller obtained by driving the drive source is X2, and X1/X2 that is a reduction ratio between X1 and X2 is X, and L2−L2/X is an interruption distance of the pickup roller configured to be generated by the transmission interruption mechanism when a conveyance distance between a trailing end of the medium reaching a position at which the medium is conveyable by the conveyance roller and the pickup roller is L2.

According to this aspect, the interruption distance of the pickup roller that can be generated by the transmission interruption mechanism satisfies formula (1). With the configuration satisfying such a formula, since the succeeding second medium can be accurately conveyed by the pickup roller after the preceding first medium reliably passes through the nip point between the separation roller and the retard roller, it is possible to particularly effectively prevent the second medium from causing jamming near the nip point between the separation roller and the retard roller.

In a medium conveying device according to an eighth aspect of the present disclosure is an aspect dependent on any one of the first to seventh aspects, the power transmission mechanism includes a first gear provided at a rotating shaft of the pickup roller, a second gear provided at a rotating shaft of the separation roller, and a third gear which is engaged with the first gear and the second gear and to which a driving force from the drive source is transmitted.

According to the present aspect, the power transmission mechanism includes the first gear provided at the rotating shaft of the pickup roller, the second gear provided at the rotating shaft of the separation roller, and the third gear that engages with the first gear and the second gear and transmits a driving force from the drive source. With such a configuration, the power of the drive source can be transmitted to the pickup roller and the separation roller with a simple configuration.

Hereinafter, the present disclosure will be specifically described. First, an outline of an inkjet printer 1 which is a medium conveying device and also a recording device according to the present disclosure will be described with reference to FIGS. 1 to 7. Hereinafter, the inkjet printer 1 is simply referred to as the printer 1. Note that, hereinafter, the direction in which a medium M is conveyed may be referred to as "downstream" and the direction opposite thereto may be referred to as "upstream".

As shown in FIG. 1 and the like, the printer 1 includes an accommodation unit 2 that accommodates a medium M. A plurality of media M can be loaded in the accommodation unit 2. In addition, in the printer 1 according to the present embodiment, a medium accommodation unit configured to accommodate the medium M can be additionally provided in a lower portion of the accommodation unit 2 but is not limited to such a configuration.

The printer 1 is provided with a pickup roller 10 that feeds the medium M stored in the accommodation unit 2 in a conveying direction A. A separation roller 11 is provided downstream of the pickup roller 10 in the conveyance path of the medium M. The medium M is conveyed in the conveying direction A toward the separation roller 11 by the pickup roller 10 and is then conveyed in the conveying direction A by the pickup roller 10 and the separation roller 11.

Here, as illustrated in FIG. 1 and the like, a retard roller 12 is provided at a position facing the separation roller 11. As described above, in the printer 1 according to the present embodiment, a plurality of media M can be stacked in the accommodation unit 2. When a first medium M1 which is the uppermost medium M stacked in the accommodation unit 2 is conveyed, a leading end Ma of a second medium M2 is made to abut on the retard roller 12 so that the second medium M2 conveyed subsequently to the first medium M1 is not doubly fed. The first medium M1 that has reached a nip point N1 between the separation roller 11 and the retard roller 12 is conveyed in the conveying direction A by the pickup roller 10 and the separation roller 11. However, the second medium M2 is in a stopped state without being conveyed because the leading end Ma of the second medium M2 abuts on the retard roller 12 and is separated from the first medium M1.

The pickup roller 10 and the separation roller 11 rotate in a first rotating direction C1 when conveying the medium M. The conveyance speed of the medium M by driving the pickup roller 10 is the same as the conveyance speed of the medium M by driving the separation roller 11. The pickup roller 10 and the separation roller 11 are connected via a plurality of gears to a motor 8 electrically connected to a control unit 7 having a CPU, a memory unit, and the like and are driven by the driving force of the motor 8.

As shown in FIG. 1 and the like, the printer 1 has an intermediate roller 13 and two driven rollers 14 provided at positions facing the intermediate roller 13 on the conveyance path of the medium M. Similar to the pickup roller 10 and the separation roller 11, the intermediate roller 13 is also connected to the motor 8 via a plurality of gears and the like. The leading end Ma of the media M conveyed in the conveying direction A by the pickup roller 10 and the separation roller 11 reaches a nip point N2 between the intermediate roller 13 and a first driven roller 14A of the driven rollers 14. Here, after the leading end Ma of the medium M reaches the nip point N2, the medium M is conveyed in the conveying direction A by the intermediate roller 13 and the first driven roller 14A. That is, the nip point N2 corresponds to a position at which conveyance can be performed by the intermediate roller 13. Further, the leading end Ma of the medium M conveyed in the conveying direction A by the intermediate roller 13 and the first driven roller 14A reaches a nip point N3 between the intermediate roller 13 and a second driven roller 14B of the driven rollers 14. After the leading end Ma reaches the nip point N3, the medium is conveyed in the conveying direction A by the intermediate roller 13 and the two driven rollers 14.

The intermediate roller 13 rotates in the first rotating direction C1 when conveying the medium M. On the other hand, both the first driven roller 14A and the second driven roller 14B rotate in the second rotating direction C2 when conveying the medium M. The conveyance speed of the medium M by driving the intermediate roller 13 is faster than the conveyance speed of the medium M by driving the pickup roller 10 and the separation roller 11. Here, when the medium M to be conveyed faces both the pickup roller 10 and the separation roller 11 and is at the nip point between the intermediate roller 13 and the driven roller 14, and when the medium M to be conveyed faces the separation roller 11 and is at the nip point between the intermediate roller 13 and the driven roller 14, the medium M is conveyed at a conveyance speed by driving the intermediate roller 13. That is, at these times, the pickup roller 10 and the separation roller 11 rotate in the first rotating direction C1 while being pulled by the medium M as the medium M is conveyed at the conveyance speed by driving the intermediate roller 13 and rotate faster than the rotation by the driving force of the motor 8.

As shown in FIG. 1 and the like, the printer 1 is provided with an insertion portion 3 into which the medium M can be manually inserted by a user. The media M inserted into the insertion portion 3 is conveyed in the conveying direction A at the nip point N3 between the intermediate roller 13 and the second driven roller 14B. Specifically, as illustrated in FIG. 1, the medium M accommodated in the accommodation unit 2 is conveyed to the nip point N3 in a conveying direction A1 of the conveying direction A, and the medium M inserted into the insertion portion 3 is conveyed to the nip point N3 in a conveying direction A2 of the conveying direction A.

The medium M whose leading end Ma reaches the nip point N3 is conveyed by the intermediate roller 13 toward a position facing a line head 6 provided in a head unit 5 that is provided downstream of the nip point N3 in the conveying direction A. Conveyance roller pairs 9 are provided upstream and downstream of the head unit 5 in the conveying direction A. The conveyance roller pairs 9 include driving rollers driven by the motor 8 and driven rollers that are driven to rotate in contact with the driving rollers.

The medium M that receives the feeding force from the conveyance roller pairs 9 is sent to a recording position facing the line head 6, which is an example of a recording unit. The line head 6 forms the head unit 5. The line head 6 discharges ink, which is an example of liquid, onto the image forming surface of the medium M to perform recording. The line head 6 is an ink discharge head configured such that nozzles that discharge ink cover the entire region in a widthwise direction B and is configured as an ink discharge head configured to perform recording in the entire region in the widthwise direction B of the medium M without moving in the widthwise direction B. However, the ink discharge head is not limited to such a configuration and may be of a type that is mounted on a carriage and discharges ink while moving in the widthwise direction B. In addition, it is also possible to use a recording unit having a configuration other than the ink discharge head, such as a thermal transfer recording unit.

The medium M on which recording has been performed by the line head 6 is conveyed by the conveyance roller pairs 9 and is discharged to a discharge tray 4. Note that there is no particular limitation on the configuration of the accommodation unit 2 that accommodates the medium M, the insertion portion 3 into which the medium M is inserted, and the discharge tray 4 on which the discharged medium M can be stacked. The accommodation unit 2 and the discharge tray 4 may be configured to stack a plurality of media M.

As described above, the printer 1 according to the present embodiment includes the accommodation unit 2 that accommodates a plurality of media including the first medium M1 and the second medium M2 conveyed following the first medium M1. The printer 1 further includes the pickup roller 10 that conveys the medium M accommodated in the accommodation unit 2 downstream in the conveying direction A, the retard roller 12 that is provided downstream of the pickup roller 10 in the conveying direction A and separates the medium M conveyed by the pickup roller 10, the separation roller 11 that abuts on the retard roller 12 and conveys the medium M downstream in the conveying direction A, and the intermediate roller 13 as a conveyance roller that is provided downstream of the separation roller 11 in the conveying direction A and conveys the medium M downstream in the conveying direction A. In addition, the printer 1 includes the motor 8 that is a drive source for generating power for rotating the pickup roller 10, the separation roller 11, and the intermediate roller 13. The printer 1 according to the present embodiment further includes a power transmission mechanism 100 that transmits power from the motor 8 to the pickup roller 10 and the separation roller 11 and a transmission interruption mechanism 101 that is provided in the power transmission mechanism 100 and interrupts the transmission of power to the pickup roller 10 during the transmission of power to the separation roller 11. Hereinafter, the power transmission mechanism 100 and the transmission interruption mechanism 101 will be described in detail.

Figure 2:
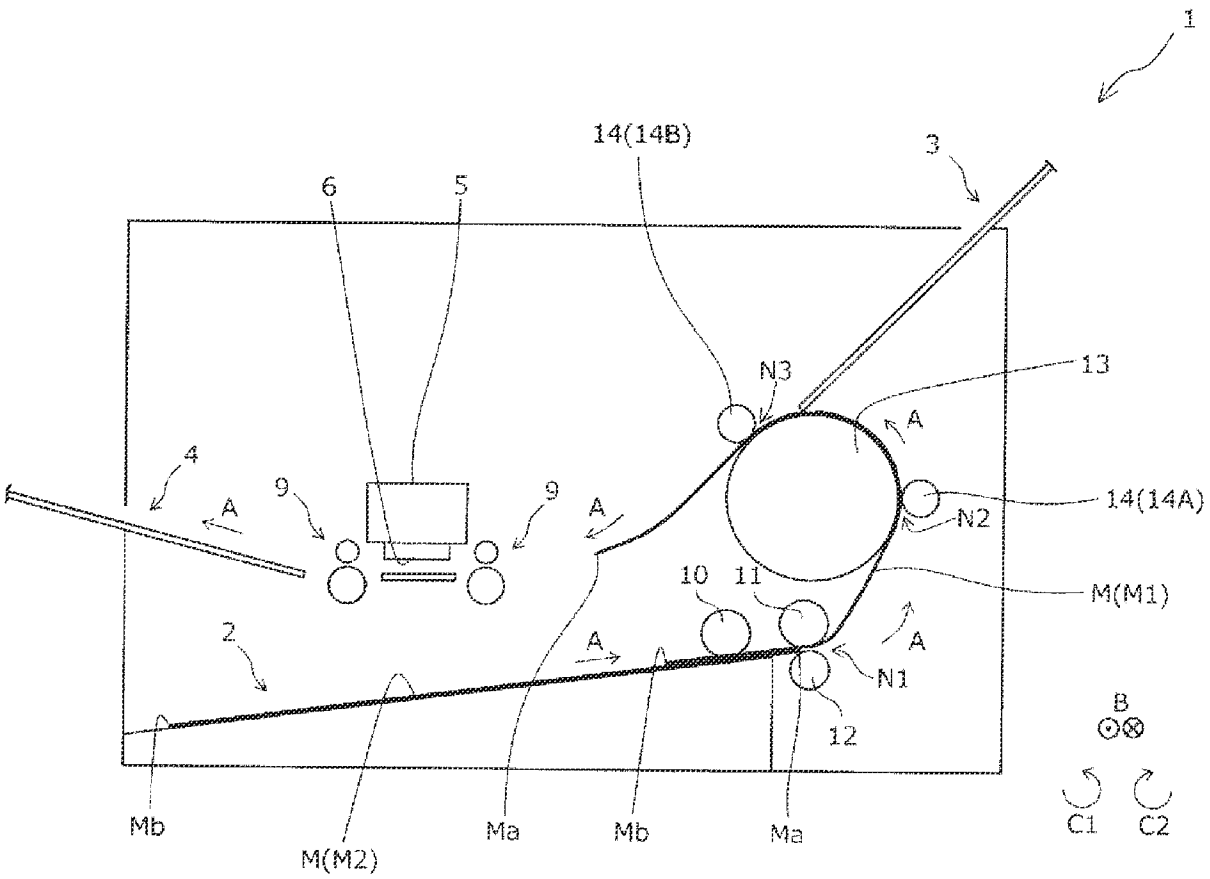
FIG. 2 is a schematic diagram illustrating a state in which a pickup roller, a separation roller, and an intermediate roller are driven to convey a first medium in the printer in FIG. 1.

First, how the power transmission mechanism 100 and the transmission interruption mechanism 101 function in the printer 1 will be described first with reference to FIGS. 2 to 7. FIG. 2 illustrates a state in which the pickup roller 10, the separation roller 11, and the intermediate roller 13 are driven in the printer 1 to convey the first medium M1, which is the first medium M, and illustrates a state in which the first medium M1 is at a position facing the pickup roller 10 and is at any position from the nip point N1 to the nip point N3. In the state of FIG. 2, the pickup roller 10, the separation roller 11, and the intermediate roller 13 are rotated in the first rotating direction C1 by driving the motor 8. However, as described above, since the conveyance speed of the medium M by driving the intermediate roller 13 is higher than the conveyance speed of the medium M by driving the pickup roller 10 and the separation roller 11, the medium M is conveyed at the conveyance speed by driving the intermediate roller 13, so that the pickup roller 10 and the separation roller 11 are pulled by the medium M and rotated in the first rotating direction C1.

Figure 3:
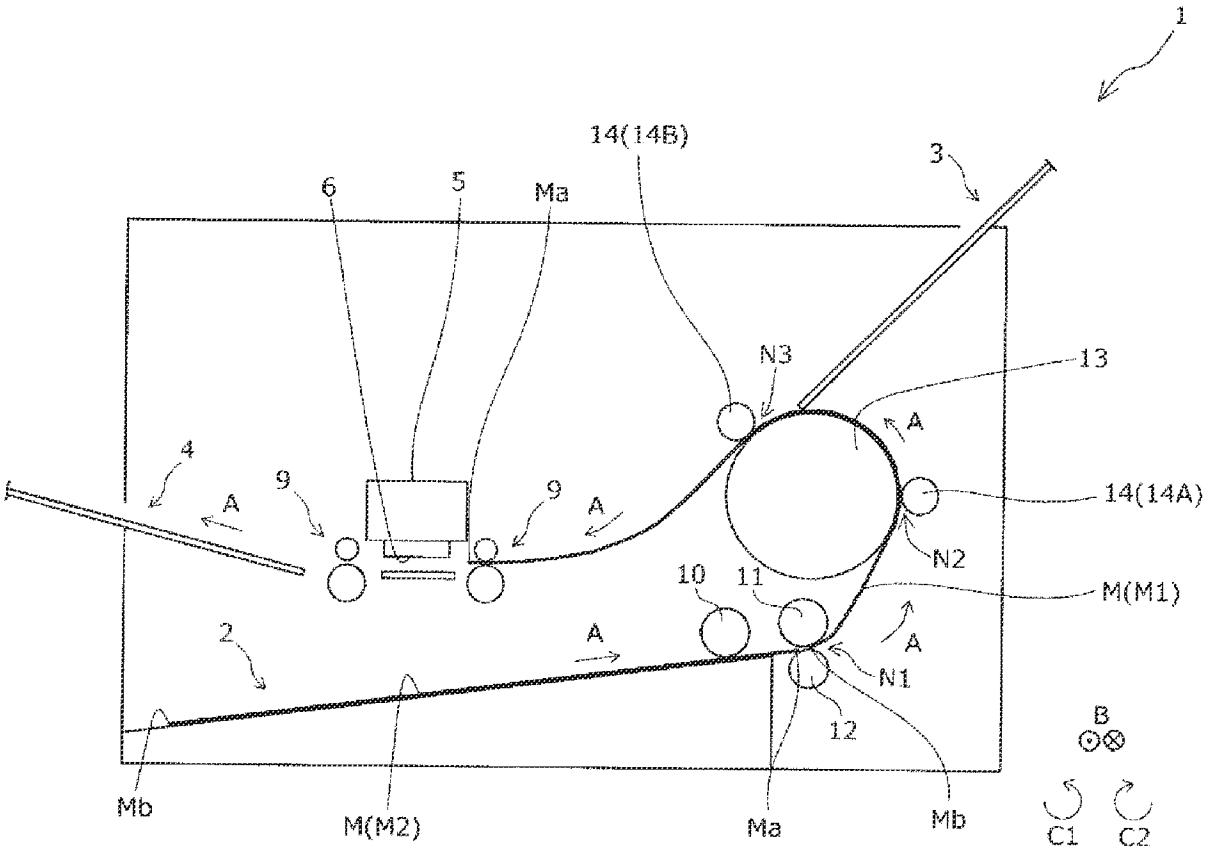
FIG. 3 is a schematic view illustrating a state after the state illustrated in FIG. 2, in which the separation roller and the intermediate roller are driven to convey the first medium, and the transmission of power to the pickup roller is stopped.

FIG. 3 illustrates a state in which the first medium M1 is further conveyed in the conveying direction A following the state illustrated in FIG. 2 and illustrates a state at a moment when a trailing end Mb of the first medium M1 has passed through the nip point N1. Here, after the state shown in FIG. 2, only the separation roller 11 and the intermediate roller 13 are driven to convey the first medium M1 by the action of the power transmission mechanism 100 and the transmission interruption mechanism 101, and the transmission of power to the pickup roller 10 is interrupted. Specifically, the transmission interruption mechanism 101 interrupts the transmission of the power to the pickup roller 10 at least after the trailing end Mb of the first medium M1 passes through the pickup roller 10 and until the trailing end Mb of the first medium M1 passes through the nip point N1. The positions of the leading end Ma and the trailing end Mb of each medium M in the conveyance path can be grasped by a sensor (not illustrated) or the like.

Figure 4:
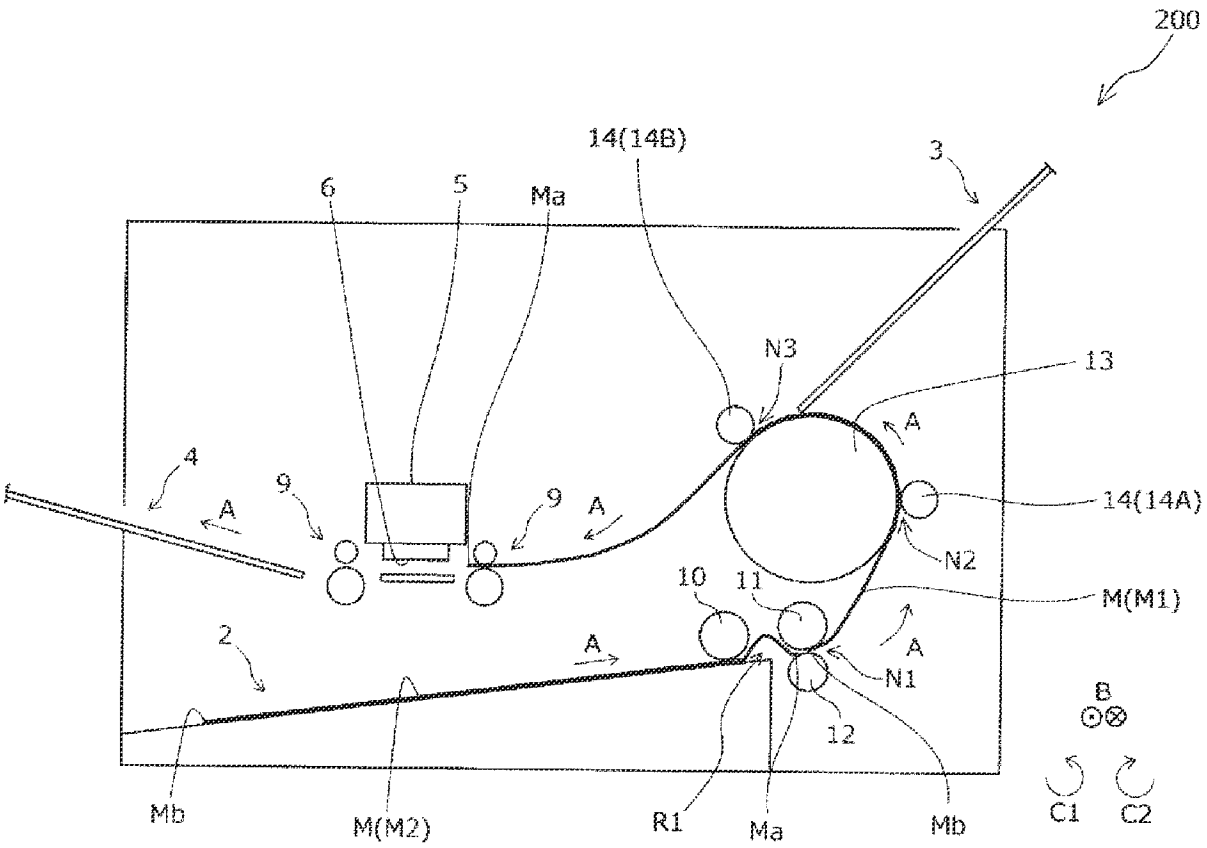
FIG. 4 is a diagram illustrating the printer according to Reference Example 1 including a power transmission mechanism that does not include a transmission interruption mechanism and is a schematic diagram illustrating a state in which the first medium is conveyed by driving the pickup roller, the separation roller, and the intermediate roller in a state in which the first medium is at the same position as the position illustrated in FIG. 3.

Here, if the pickup roller 10, the separation roller 11, and the intermediate roller 13 continue to be driven even after the state illustrated in FIG. 3, there is a concern that jamming may occur in a region R1 between the pickup roller 10 and the separation roller 11 in the conveyance path of the medium M. FIG. 4 illustrates a state in which the first medium M1 is further conveyed in the conveying direction A following the state illustrated in FIG. 2 using a printer 200 according to Reference Example 1 in which the power transmission mechanism 100 does not include the transmission interruption mechanism 101. In the state illustrated in FIG. 2, since the leading end Ma of the second medium M2, which is the second medium M, abuts on the retard roller 12, if a conveyance force in the conveying direction A is applied to the second medium M2, bending or the like may occur near the leading end Ma in the region R1. Since the printer 200 according to Reference Example 1 does not have the transmission interruption mechanism 101 in the power transmission mechanism 100, the pickup roller 10 rotates in the first rotating direction C1 even after the trailing end Mb of the first medium M1 has passed through the pickup roller 10 after the state shown in FIG. 2, and hence a conveyance force in the conveying direction A is applied from the pickup roller 10 to the second medium M2 after the trailing end Mb of the first medium M1 has passed through the pickup roller 10. For this reason, in FIG. 4, bending occurs near the leading end Ma in the region R1, and jamming occurs.

Figure 5:
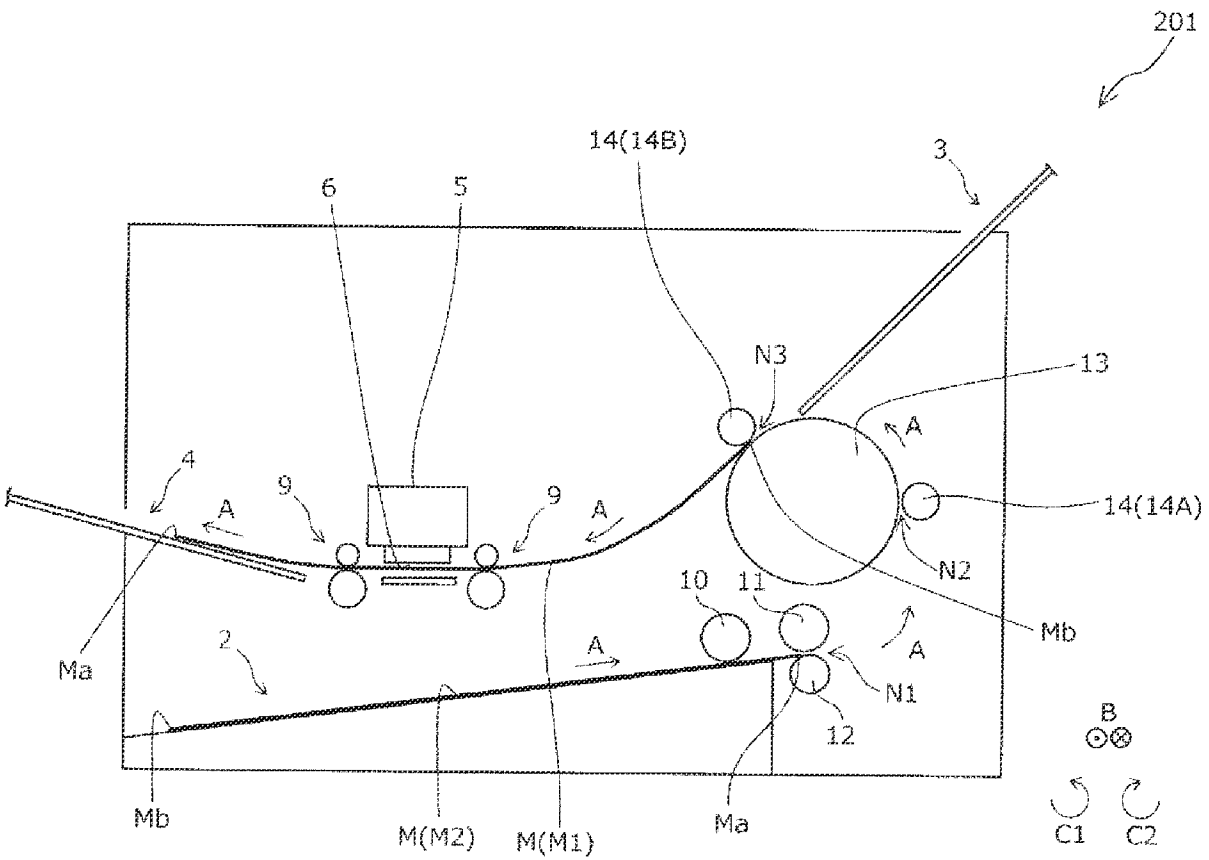
FIG. 5 is a diagram showing a printer according to Reference Example 2 including a power transmission mechanism different from the printer in FIG. 1 and is a schematic diagram showing, after a state similar to the state shown in FIG. 2, a state in which the intermediate roller is driven to convey the first medium, and the transmission of power to the separation roller and the pickup roller is interrupted.

On the other hand, FIG. 5 illustrates a state in which after the state illustrated in FIG. 2 and the trailing end Mb of the first medium M1 has passed through the pickup roller 10, the first medium M1 is further conveyed in the conveying direction A so as not to cause jamming using the printer 201 according to Reference Example 2 in which the power transmission mechanism 100 does not include the transmission interruption mechanism 101. More specifically, FIG. 5 illustrates a state at the moment when the trailing end Mb of the first medium M1 passes through the nip point N3 and a state immediately before the start of conveyance of the second medium M2. The printer 201 according to Reference Example 2 includes the power transmission mechanism 100 configured to individually drive the intermediate roller 13, the pickup roller 10, and the separation roller 11. As illustrated in FIG. 5, if the conveyance of the second medium M2 is started after the trailing end Mb of the first medium M1 passes through the nip point N3, the occurrence of jamming can be suppressed. However, if such a configuration is adopted, the distance between the trailing end Mb of the first medium M1 and the leading end Ma of the second medium M2 in the conveyance path becomes long. This increases the time required for the entire conveyance when the plurality of media M are continuously conveyed.

Figure 6:
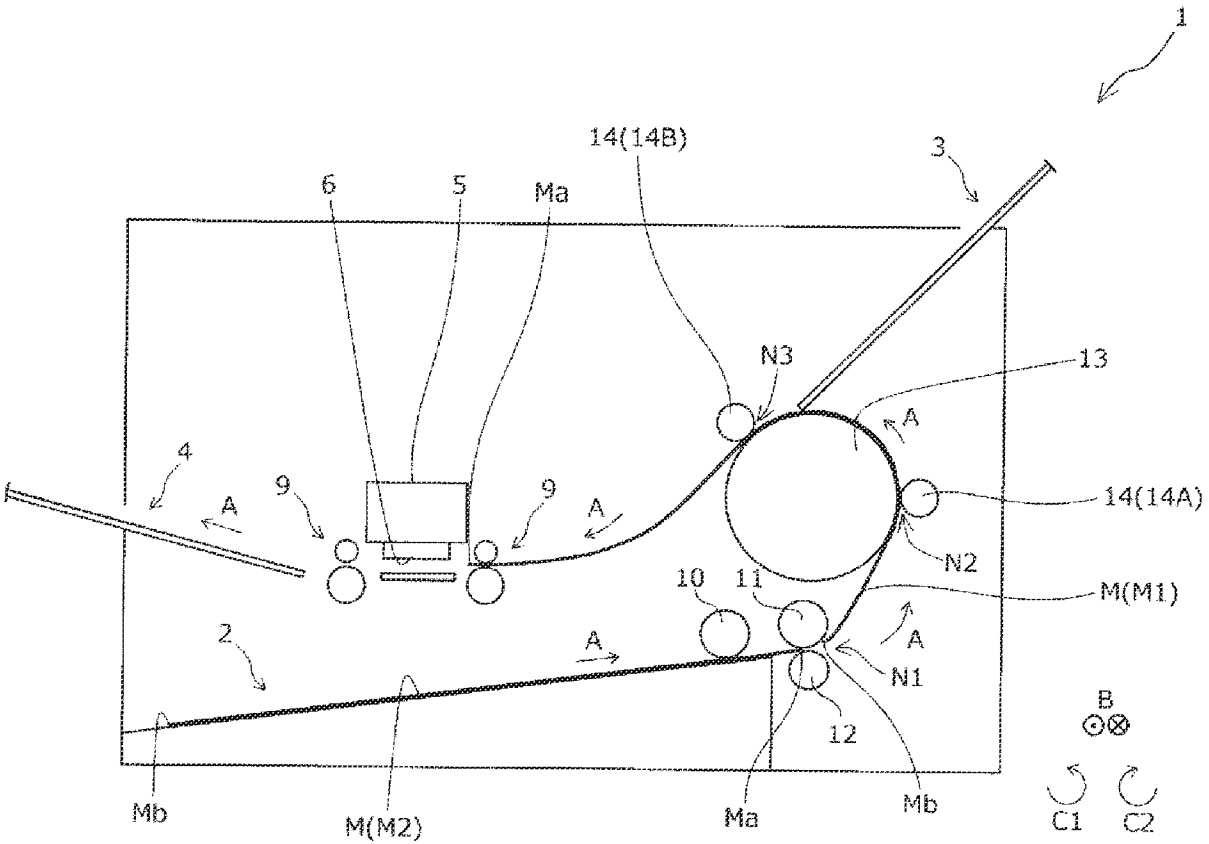
FIG. 6 is a schematic view showing a state in which the intermediate roller is driven to convey the first medium, and the pickup roller is driven to convey the second medium, following the state shown in FIG. 3.

Therefore, in the printer 1 according to the present embodiment, as shown in FIG. 6, following the state shown in FIG. 3, after the trailing end Mb of the first medium M1 passes through the nip point N1, the intermediate roller 13 is driven to convey the first medium M1, and the pickup roller 10 is driven to convey the second medium M2. In the state shown in FIG. 3, since the driving of the pickup roller 10 is stopped, the occurrence of jamming is suppressed. Then, as shown in FIG. 6, the power transmission mechanism 100 resumes the transmission of power to the pickup roller 10 after the trailing end Mb of the first medium M1 passes through the nip point N1.

Figure 7:
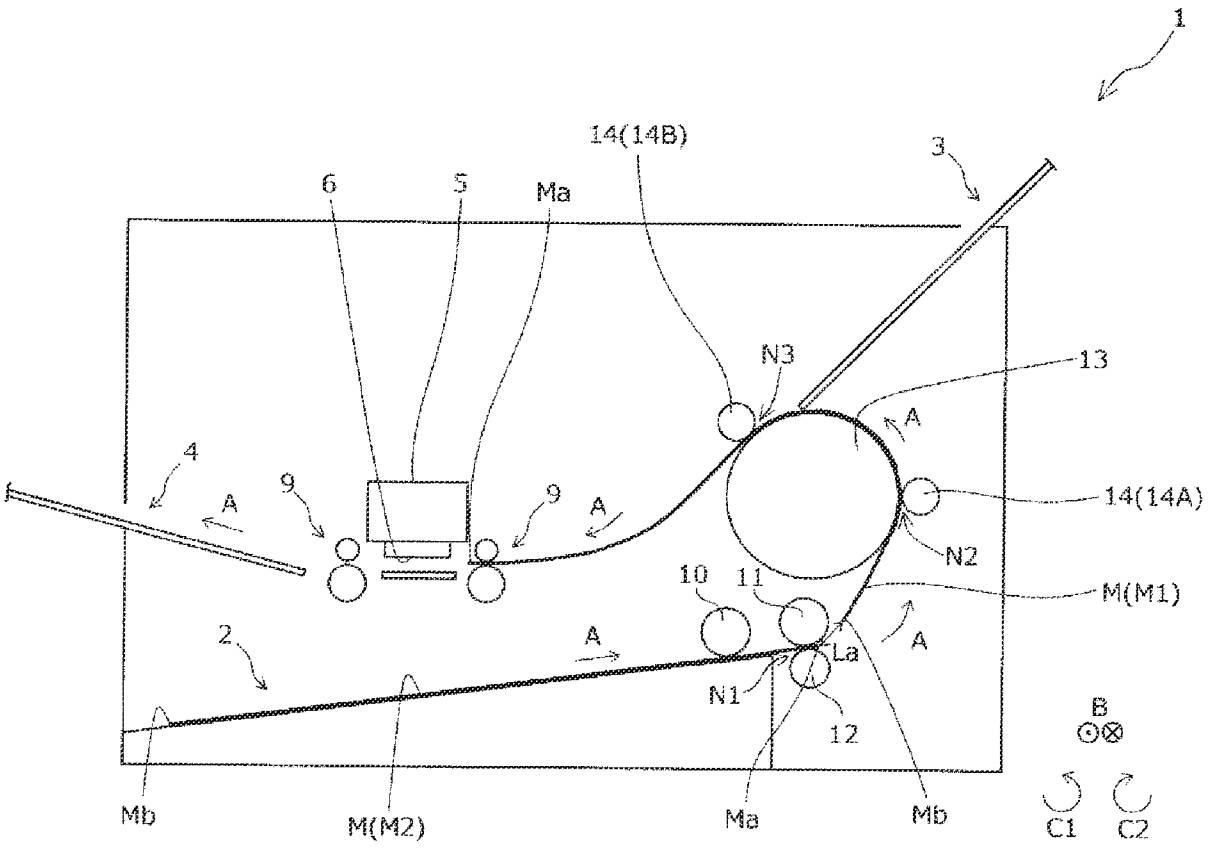
FIG. 7 is a schematic view showing a state immediately after the intermediate roller is driven to convey the first medium, and the pickup roller and the separation roller are driven to start conveying the second medium, following the state shown in FIG. 6.

FIG. 7 illustrates a state in which, subsequent to the state illustrated in FIG. 6, the intermediate roller 13 is driven to convey the first medium M1 and the pickup roller 10 and the separation roller 11 are driven to convey the second medium M2. As described above, the conveyance speed (first conveyance speed) of the medium M by driving the intermediate roller 13 is faster than the conveyance speed (second conveyance speed) of the medium M by driving the pickup roller 10 and the separation roller 11. Therefore, until the leading end Ma of the second medium M2 reaches the nip point N1, the conveyance speed of the first medium M1 is faster than the conveyance speed of the second medium M2. Accordingly, until the leading end Ma of the second medium M2 reaches the nip point N2, a distance La between the trailing end Mb of the first medium M1 and the leading end Ma of the second medium M2 increases. However, in the printer 1 according to the present embodiment, the distance from the nip point N1 to the nip point N2 is adjusted such that the distance La that increases as the first medium M1 and the second medium M2 are conveyed in the state shown in FIGS. 6 and 7 becomes an optimum distance. For this reason, when a plurality of media M are continuously conveyed, it is also possible to suppress an increase in time required for the entire conveyance.

As described above, the printer 1 according to the present embodiment includes the transmission interruption mechanism 101 that interrupts the transmission of power to the pickup roller 10 during the transmission of the power to the separation roller 11, and the transmission interruption mechanism 101 is configured to interrupt the transmission of the power to the pickup roller 10 after the pickup roller 10 conveys the trailing end Mb of the first medium M1 in the conveying direction A. Accordingly, the printer 1 according to the present embodiment is a medium conveying device including the pickup roller 10, the separation roller 11, the retard roller 12, and the intermediate roller 13 as a conveyance roller. However, even in the medium conveying device having such a configuration, it is possible to improve the conveyance performance when the second medium M2 is conveyed following the first medium M1. This is because when the second medium M2 is conveyed following the first medium M1, the second medium M2 can be prevented from being conveyed by the pickup roller 10 before the trailing end Mb of the first medium M1 in the conveying direction A passes through the nip point N1 between the separation roller 11 and the retard roller 12, and the second medium M2 can be effectively prevented from causing jamming near the nip point N1 between the separation roller 11 and the retard roller 12.

In addition, the printer 1 according to the present embodiment is configured to include the motor 8 as a drive source which generates power for rotating the pickup roller 10, the separation roller 11, and the intermediate roller 13 and the power transmission mechanism 100 which transmits the power to the pickup roller 10 and the separation roller 11. With such a configuration, for example, the plurality of media M can be separated without switching the rotating direction of the motor 8, and the distance La which is the interval between the first medium M1 and the second medium M2 in the conveying direction A can be narrowed. Since it is possible to continuously convey a large number of media M in a short time by narrowing the distance La, it is also possible to improve conveyance efficiency when a plurality of media M are conveyed.

As described above, the transmission interruption mechanism 101 of the printer 1 according to the present embodiment is configured to interrupt the transmission of power from the motor 8 to the pickup roller 10 until the trailing end Mb of the first medium M1 exceeds the nip point N1, that is, until the separation roller 11 conveys the trailing end Mb of the first medium M1. In other words, after the separation roller 11 finishes conveying the first medium M1, the pickup roller 10 can convey the second medium M2. With this configuration, after the preceding first medium M1 reliably passes through the nip point N1, the succeeding second medium M2 can be conveyed by the pickup roller 10. Accordingly, it is possible to particularly effectively prevent the second medium M2 from jamming near the nip point N1.

Figure 8:
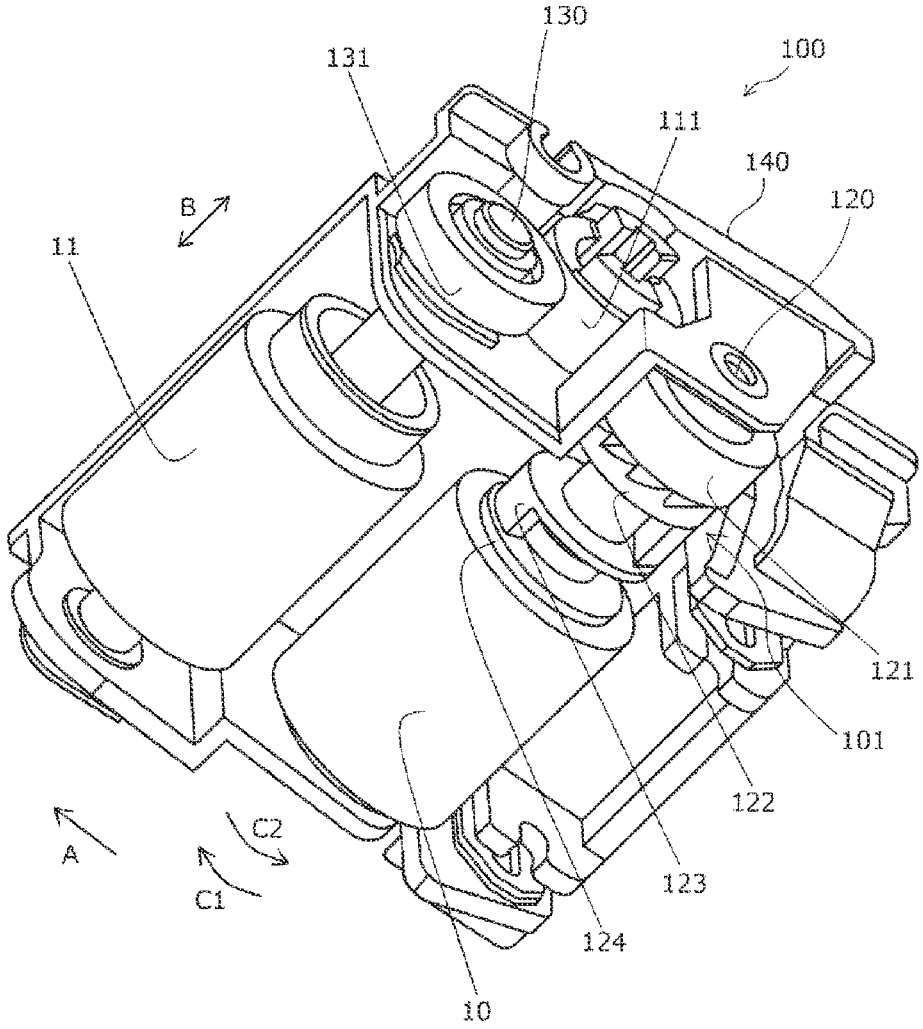
FIG. 8 is a perspective view showing the power transmission mechanism of the printer in FIG. 1.
Figure 9:
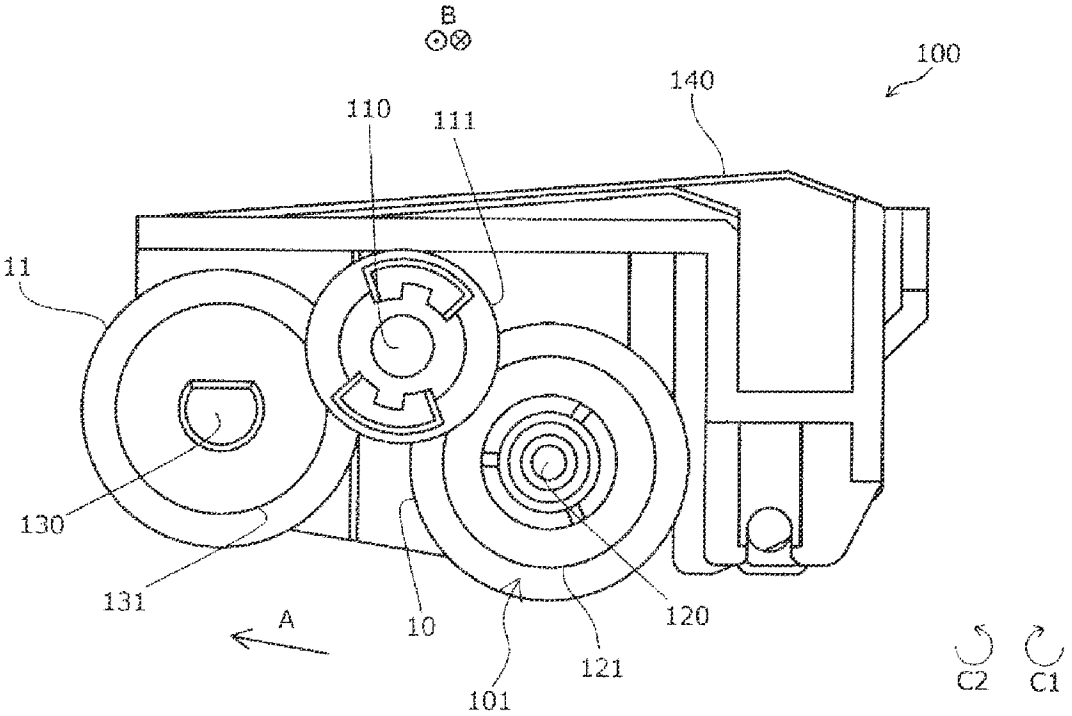
FIG. 9 is a side view showing the power transmission mechanism of the printer in FIG. 1.

Here, the specific configurations of the power transmission mechanism 100 and the transmission interruption mechanism 101 will be described with reference to FIGS. 8 to 14. As illustrated in FIGS. 8 and 9, the power transmission mechanism 100 of the printer 1 according to the present embodiment includes a gear 111 as well as a gear 121 and a gear 131 that engage with the gear 111. As shown in FIG. 9, the gear 111 is provided at a rotating shaft 110, the gear 121 is provided at a rotating shaft 120, and the gear 131 is provided at a rotating shaft 130. The rotating shaft 110, the rotating shaft 120, and the rotating shaft 130 are all attached to a base portion 140 so as to extend in the widthwise direction B. The rotating shaft 120 also serves as a rotating shaft of the pickup roller 10, and the rotating shaft 130 also serves as the rotating shaft of the separation roller 11. The gear 111 is configured to be rotatable at least in the second rotating direction C2 by receiving a driving force from the motor 8 via a gear (not illustrated).

As described above, the power transmission mechanism 100 of the printer 1 according to the present embodiment includes the gear 111 as the third gear engaged with the gear 121 as the first gear provided at the rotating shaft 120 of the pickup roller 10 and the gear 131 as the second gear provided at the rotating shaft 130 of the separation roller 11. Here, the gear 111 is a gear to which the drive force from the motor 8 as the drive source is transmitted. With such a configuration, the power of the motor 8 can be transmitted to the pickup roller 10 and the separation roller 11 with a simple configuration.

Figure 10:
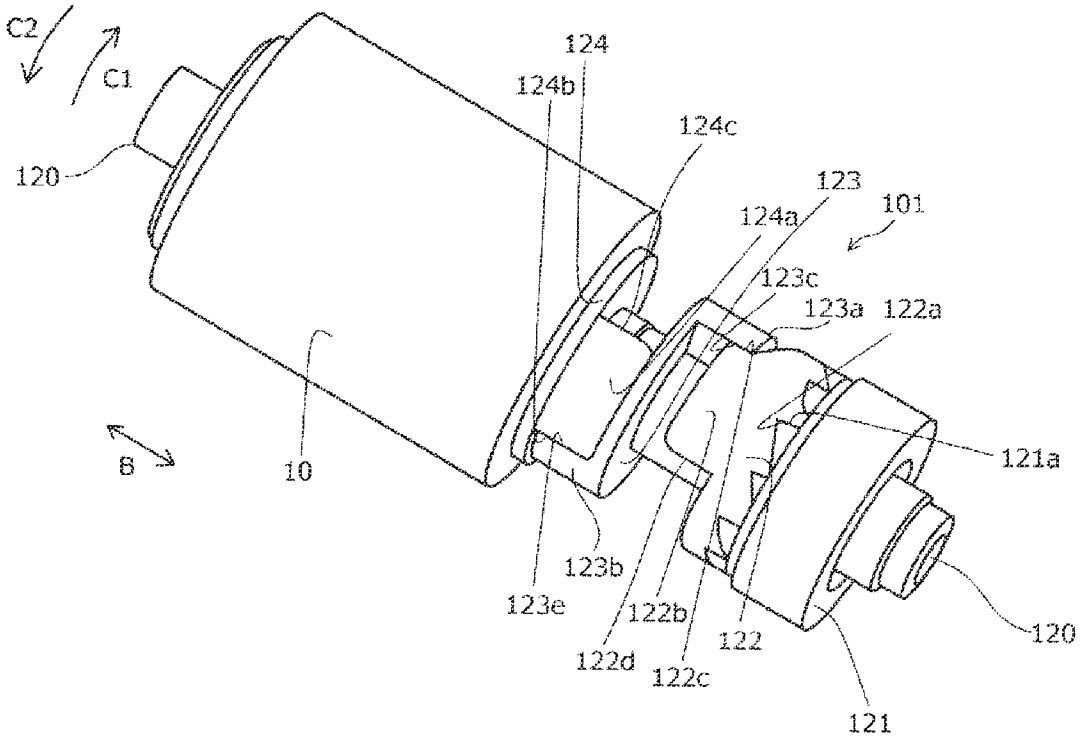
FIG. 10 is a perspective view showing the transmission interruption mechanism of the power transmission mechanism in FIGS. 8 and 9, showing a state where the interruption distance is the shortest.
Figure 11:
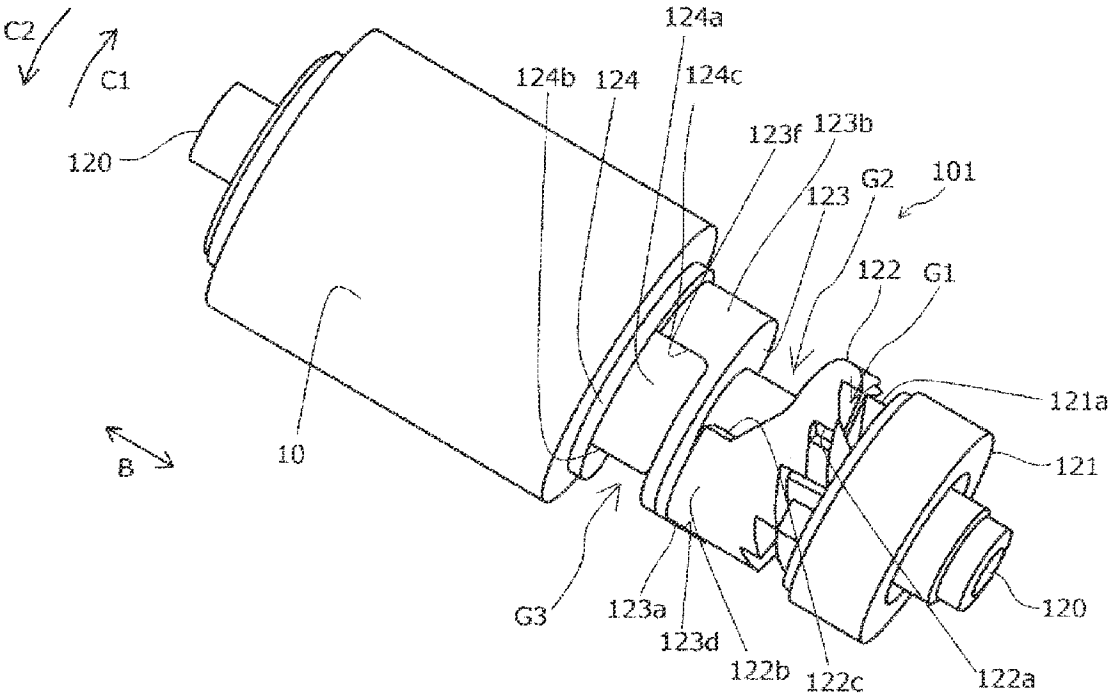
FIG. 11 is a perspective view showing the transmission interruption mechanism of the power transmission mechanism in FIGS. 8 and 9, showing a state where the interruption distance is the longest.

As shown in FIGS. 8 and 9, the transmission interruption mechanism 101 is provided in the power transmission mechanism 100. As shown in FIGS. 10 and 11, the power transmission mechanism 100 includes a gear 121 rotatable with respect to the rotating shaft 120, a first rotating member 122 rotatable with respect to the rotating shaft 120, a second rotating member 123 rotatable with respect to the rotating shaft 120, and a third rotating member 124 provided with the pickup roller 10 and configured integrally with the rotating shaft 120.

The gear 121 has a teeth portion 121*a* on the pickup roller 10 side in the widthwise direction B. In addition, the first rotating member 122 has a teeth portion 122*a* that is meshed with a teeth portion 121*a* when the gear 121 relatively rotates in the first rotating direction C1 and is idle without being meshed when the gear 121 relatively rotates in the second rotating direction C2. In addition, the first rotating member 122 has a protruding portion 122*b* that protrudes toward the pickup roller 10 in the widthwise direction B. The protruding portion 122*b* has a wall portion 122*c* on the leading side in the first rotating direction C1 and a wall portion 122*d* on the leading side in the second rotating direction C2. Note that the case in which the teeth portion relatively rotates in the second rotating direction C2 includes the case in which the teeth portion relatively rotates in the second rotating direction C2 due to the speed difference between the teeth portions although both rotate in the first rotating direction C1.

The second rotating member 123 has a protruding portion 123*a* protruding toward the gear 121 in the widthwise direction B. The protruding portion 123*a* has a wall portion 123*c* that abuts on the wall portion 122*c* of the protruding portion 122*b* when the first rotating member 122 rotates in the first rotating direction C1 relative to the second rotating member 123 and has a wall portion 123*d* that abuts on the wall portion 122*d* of the protruding portion 122*b* when the first rotating member 122 rotates in the second rotating direction C2 relative to the second rotating member 123. In addition, the second rotating member 123 has a protruding portion 123*b* that protrudes toward the pickup roller 10 in the widthwise direction B. The protruding portion 123*b* has a wall portion 123*e* on the leading side in the first rotating direction C1 and a wall portion 123*f* on the leading side in the second rotating direction C2.

The third rotating member 124 has a protruding portion 124*a* protruding toward the gear 121 in the widthwise direction B. The protruding portion 124*a* has a wall portion 124*b* that abuts on the wall portion 123*e* of the protruding portion 123*b* when the second rotating member 123 rotates in the first rotating direction C1 relative to the third rotating member 124 and has a wall portion 124*c* that abuts on the wall portion 123*f* of the protruding portion 123*b* when the second rotating member 123 rotates in the second rotating direction C2 relative to the third rotating member 124.

Here, referring FIG. 11, a gap G1 is formed between the teeth portion 121*a* and the teeth portion 122*a*, a gap G2 is formed between the wall portion 122*c* and the wall portion 123*c*, and a gap G3 is formed between the wall portion 123*e* and the wall portion 124*b*. On the other hand, referring to FIG. 10, the gap G1, the gap G2, and the gap G3 are not formed. That is, the gap G1 is maximized when the distance between the teeth portion 121*a* and the teeth portion 122*a* is maximized, the gap G2 is maximized when the wall portion 122*d* and the wall portion 123*d* abut on each other, and the gap G3 is maximized when the wall portion 123*f* and the wall portion 124*c* abut on each other. On the other hand, the gap G1 becomes minimum (0) when the distance between the teeth portion 121*a* and the teeth portion 122*a* is 0, the gap G2 becomes minimum (0) when the wall portion 122*c* and the wall portion 123*c* abut on each other, and the gap G3 becomes minimum (0) when the wall portion 123*e* and the wall portion 124*b* abut on each other.

Figure 12:
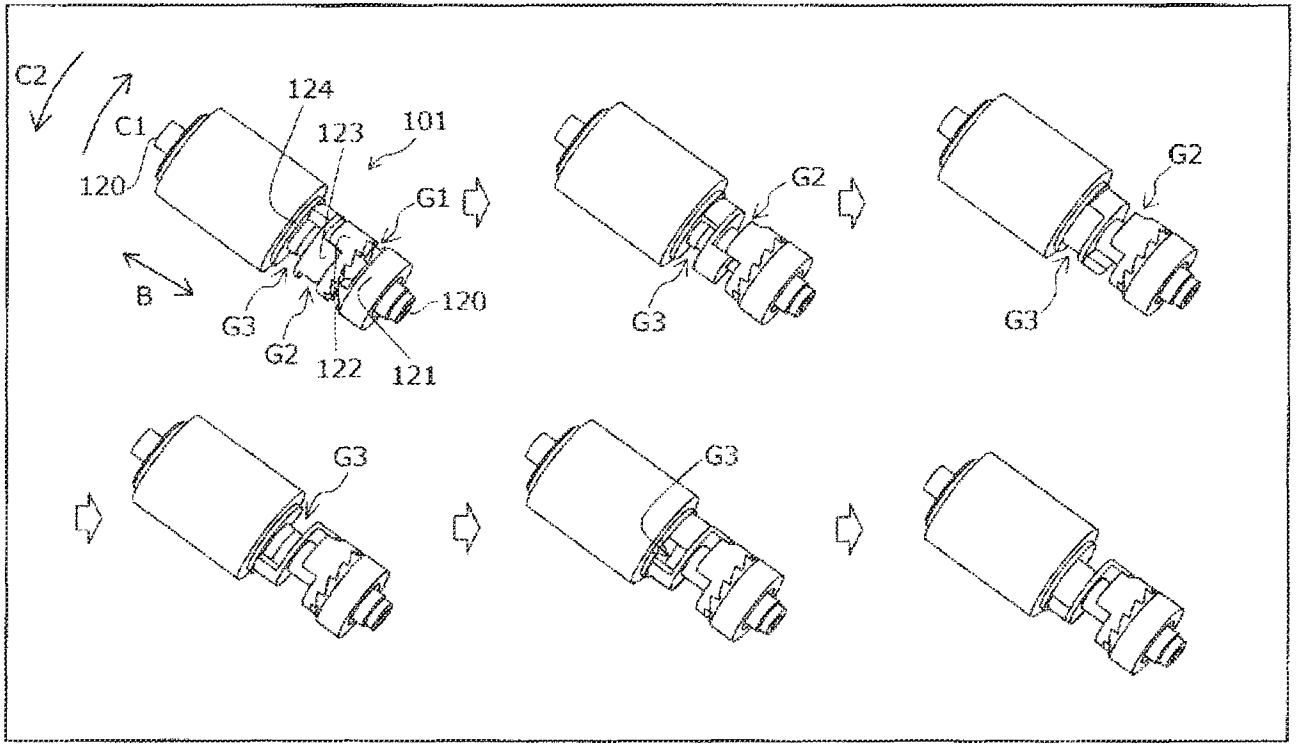
FIG. 12 is a perspective view showing the transmission interruption mechanism in FIGS. 10 and 11, showing an example of displacement from a state where the interruption distance is the longest to a state where the interruption distance is the shortest.
Figure 13:
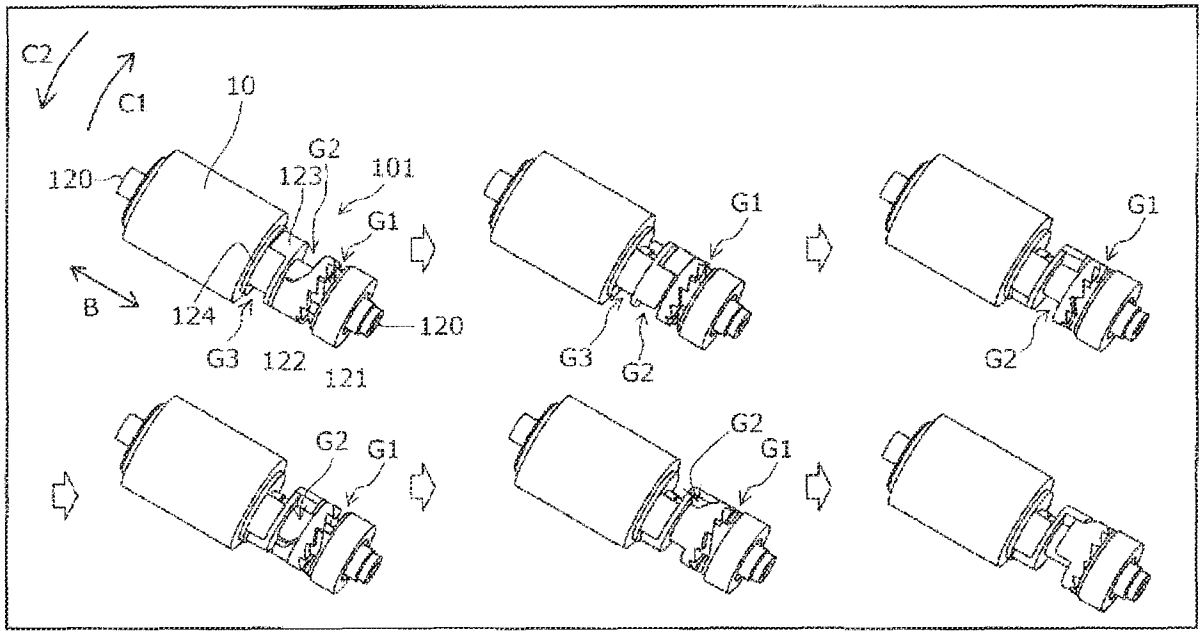
FIG. 13 is a perspective view showing the transmission interruption mechanism in FIGS. 10 and 11, showing an example (different from the state in FIG. 12) of displacement from a state where the interruption distance is the longest to a state where the interruption distance is the shortest.

If any one of the gaps G1, G2, and G3 occurs, at least one of the first rotating member 122, the second rotating member 123, and the third rotating member 124 idles, and the pickup roller 10 does not rotate even when the gear 121 is rotated in the first rotating direction C1. Accordingly, when the sum of the gap G1, the gap G2, and the gap G3 is long, the interruption distance generated by the transmission interruption mechanism 101 is long, whereas when the sum of the gap G1, the gap G2, and the gap G3 is short, the interruption distance generated by the transmission interruption mechanism 101 is short. The interruption distance corresponds to a distance by which the medium M can be conveyed in a state where the rotation of the pickup roller 10 is interrupted. Hereinafter, for example, an example of the movement of the transmission interruption mechanism 101 from a state in which the sum of the gap G1, the gap G2, and the gap G3 becomes maximum, for example, a state corresponding to when the rotation of the pickup roller 10 is interrupted during a period until the trailing end Mb of the first medium M1 passes through the pickup roller 10, to a state in which the sum becomes minimum will be described with reference to FIGS. 12 and 13. FIG. 12 illustrates a case in which no frictional force is generated between the rotating shaft 120 (the third rotating member 124) and the gear 121, the first rotating member 122, and the second rotating member 123. FIG. 13 illustrates a case in which a frictional force is generated between the rotating shaft 120 (the third rotating member 124) and the gear 121, the first rotating member 122, and the second rotating member 123.

The state on the upper left in FIG. 12 corresponds to FIG. 11 and represents a state in which the sum of the gap G1, the gap G2, and the gap G3 is maximum. When the gear 121 rotates in accordance with the driving of the motor 8 from this state, the state shifts to the state on the upper middle in FIG. 12, and the gap G1 is closed. Thereafter, the state shifts to the state on the upper right in FIG. 12, and the gap G2 is gradually closed. Subsequently, when the state shifts to the state on the lower left in FIG. 12, the gap G2 is closed. The state further shifts to the state on the lower middle in FIG. 12, and the gap G3 is gradually closed. Finally, the state shifts to the state on the lower right in FIG. 12 corresponding to FIG. 10, and the gap G3 is also closed. When the gear 121 rotates along with the driving of the motor 8, the order of closing of the gap G1, the gap G2, and the gap G3 is that the gap G1 is closed first, then the gap G2 is closed, and finally the gap G3 is closed.

The state on the upper left in FIG. 13 corresponds to FIG. 11 and represents a state in which the sum of the gap G1, the gap G2, and the gap G3 is maximum. When the gear 121 rotates in accordance with the driving of the motor 8 from this state, the state shifts to the state on the upper middle in FIG. 13, and the gap G3 is closed. Thereafter, the state shifts to the state on the upper left in FIG. 13, and the gap G3 is closed. Thereafter, the state shifts to the state on the lower left in FIG. 13 and the state on the lower middle in FIG. 13, and the gap G2 is gradually closed. Finally, the state shifts to the state on the lower right in FIG. 13 corresponding to FIG. 10, and the gap G2 is closed, and the gap G1 is also closed following the state of the gap G2.

As described above, the transmission interruption mechanism 101 of the printer 1 according to the present embodiment has the second rotating member 123 on the rotating shaft 120. The pickup roller 10 has the wall portion 124*b* as an abutment portion. The second rotating member 123 has the wall portion 123*e* as an abutted portion. Here, the wall portion 123*e* of the second rotating member 123 abuts on the wall portion 124*b* by rotating in the first rotating direction C1 which is a rotating direction when conveying the medium M with respect to the rotating shaft 120 by the transmission of power from the motor 8. On the other hand, the wall portion 123*e* rotates in the first rotating direction C1 at a rotation speed faster than the rotation in the first rotating direction C1 due to the transmission of power from the motor 8 as a result of the pickup roller 10 being pulled by the medium M or the like, that is, the wall portion 123*e* is separated from the wall portion 124*b* by receiving a force relatively in the second rotating direction C2. The transmission interruption mechanism 101 is configured to interrupt the transmission of power from the motor 8 to the pickup roller 10 while the wall portion 123*e* is displaced from the separated state with respect to the wall portion 124*b* as shown in FIG. 11 to the abutting state with respect to the wall portion 124*b* as shown in FIG. 10 as the second rotating member 123 rotates in the first rotating direction C1. With such a configuration, the printer 1 according to the present embodiment can easily form the transmission interruption mechanism 101 in a small size.

As described above, in the printer 1 according to the present embodiment, the first conveyance speed which is the conveyance speed when the medium M is conveyed by the intermediate roller 13 by driving the motor 8 is higher than the second conveyance speed which is the conveyance speed when the medium M is conveyed by the pickup roller 10 by driving the motor 8. In the printer 1 according to the present embodiment, when the medium M is conveyed by both the intermediate roller 13 and the pickup roller 10 by driving the motor 8, the medium M is conveyed at the first conveyance speed, and the pickup roller 10 receives a force from the medium M relatively in the second rotating direction C2 as the medium M is conveyed at the first conveyance speed, whereby the second rotating member 123 is displaced from a state in which the wall portion 123*e* abuts on the wall portion 124*b* to a state in which the wall portion 123*e* is separated from the wall portion 124*b*. For this reason, in the printer 1 according to the present embodiment, it is possible to efficiently generate the time for waiting for the conveyance of the second medium M2 when the second medium M2 is conveyed following the first medium M1 every time the medium M is conveyed in the transmission interruption mechanism 101.

In other words, in the printer 1 according to the present embodiment, when the first medium M1 is conveyed in a state of being at the position facing the pickup roller 10 as well as at the nip point N1 and the nip point N2, the second rotating member 123 is displaced from a state in which the wall portion 123*e* abuts on the wall portion 124*b* to a state in which the wall portion 123*e* is separated from the wall portion 124*b*. In still another expression, in the printer 1 according to the present embodiment, when the first medium M1 is conveyed in a state of being at the position facing the pickup roller 10 as well as at the nip point N1 and the nip point N2, the state in which the sum of the gap G1, the gap G2, and the gap G3 is minimum shifts to the state in which the sum is maximum. Therefore, hereinafter, an example of the movement of the transmission interruption mechanism 101 from the state in which the sum of the gap G1, the gap G2, and the gap G3 is minimum to the state in which the sum is maximum will be described with reference to FIG. 14.

Figure 14:
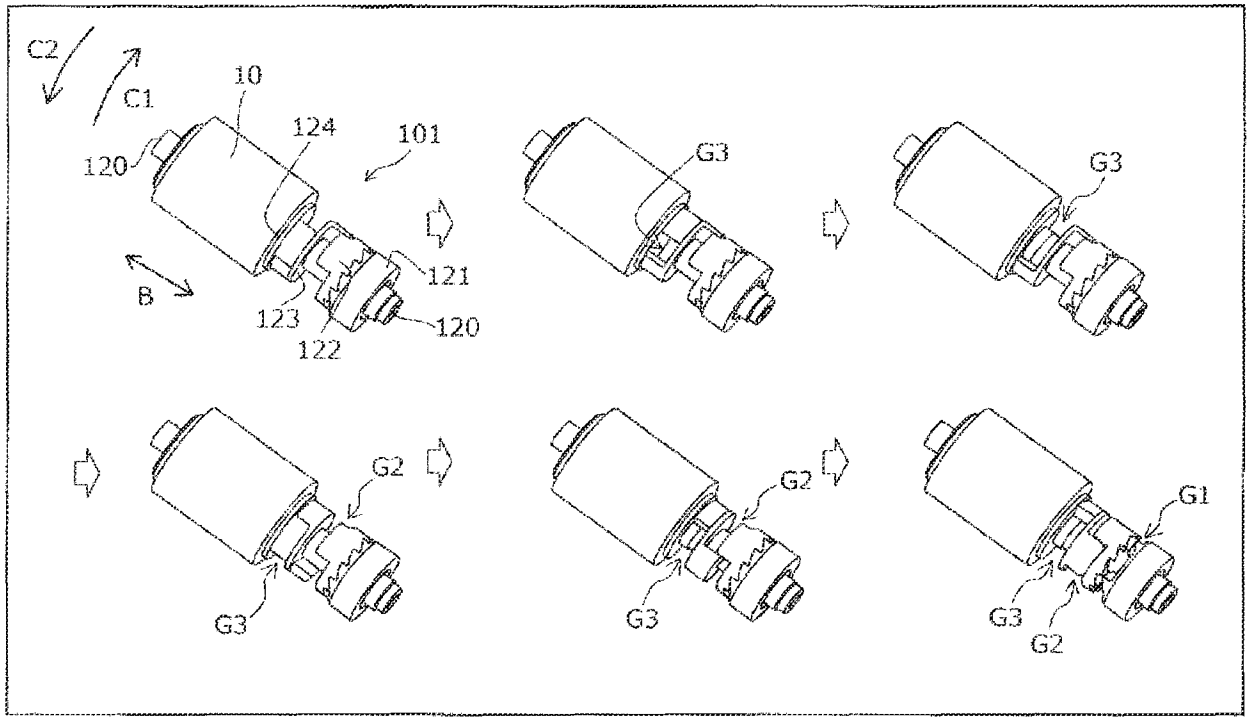
FIG. 14 is a perspective view showing the transmission interruption mechanism in FIGS. 10 and 11, showing an example of displacement from a state where the interruption distance is the shortest to a state where the interruption distance is the longest.

The state on the upper left side in FIG. 14 corresponds to FIG. 10 and represents a state in which the sum of the gaps G1, G2, and G3 is minimum (0). From this state, when the first medium M1 is conveyed in a state where the first medium M1 is located at the position facing the pickup roller 10 as well as at the nip point N1 and the nip point N2, the pickup roller 10 is pulled by the first medium M1 and starts to rotate in the first rotating direction C1 by a rotation amount larger than the rotation amount based on the driving force of the motor 8 and shifts to the state on the upper middle in FIG. 14, and the gap G3 starts to be formed. When the conveyance of the first medium M1 further proceeds in this state, the state shifts to the state on the upper right in FIG. 14. The gap G3 then becomes wider, the wall portion

123*e* abuts on the wall portion 124*b*, and the gap G3 becomes maximum. Thereafter, the state shifts to the state on the lower left in FIG. 14, and the second rotating member 123 starts to rotate in the first rotating direction C1, whereby the gap G2 starts to be formed. Subsequently, the state shifts to the state on the lower middle in in FIG. 14, the wall portion 122*d* abuts on the wall portion 123*d*, and the gap G2 becomes maximum. Finally, the state shifts to the state on the lower right in FIG. 14 corresponding to FIG. 11, and the first rotating member 122 is pushed by the second rotating member 123 to rotate in the first rotating direction C1 with respect to the gear 121, thereby forming the gap G1 between the teeth portion 121*a* and the teeth portion 122*a*. The formation order of the gap G1, the gap G2, and the gap G3 may be different from that shown in FIG. 14.

When the operation of the transmission interruption mechanism 101 illustrated in FIG. 14 is executed, the sum of the gaps G1, G2, and G3 may be maximized after the last conveyance of the medium M corresponding to the end of the execution command of one recording operation, as expressed by the state on the lower right in FIG. 14 corresponding to FIG. 11. However, in such a state, the start of the first conveyance operation of the medium M in response to the execution command of the next recording operation is delayed by the length of the interruption time corresponding to the maximum sum of the gaps G1, G2, and G3. Therefore, in the printer 1 according to the present embodiment, it is possible to close the gaps G1, G2, and G3 by driving the motor 8 after the last medium M is conveyed.

From another point of view, as illustrated in FIG. 1, the printer 1 according to the present embodiment includes a reception unit 20 that receives a recording operation execution instruction from a user, that is, a conveyance instruction of the medium M. After completion of the conveyance instruction received by the reception unit 20, the printer 1 is configured to minimize the sum of the gap G1, the gap G2, and the gap G3, for example, by making the wall portion 123*e* abut on the wall portion 124*b*, so that the pickup roller 10 can immediately rotate in the first rotating direction C1 in accordance with the next conveyance instruction. For this reason, in the printer 1 according to the present embodiment, it is possible to suppress the delay of the start of the conveyance by the pickup roller 10 when the reception unit 20 receives the next conveyance instruction every time the reception unit 20 receives a conveyance instruction.

More specifically, the printer 1 according to the present embodiment is configured to continue the rotation of the pickup roller 10 in the first rotating direction C1 by driving the motor 8 after the trailing end Me of the last medium M to be conveyed passes through the position at which conveyance can be performed by the pickup roller 10 after completion of the execution of the conveyance instruction received by the reception unit 20 is finished. With such a configuration, with a simple configuration and a simple control, it is possible to prevent the pickup roller 10 from delaying the start of conveyance when the reception unit 20 receives the next conveyance instruction every time the reception unit 20 receives a conveyance instruction.

Figure 15:
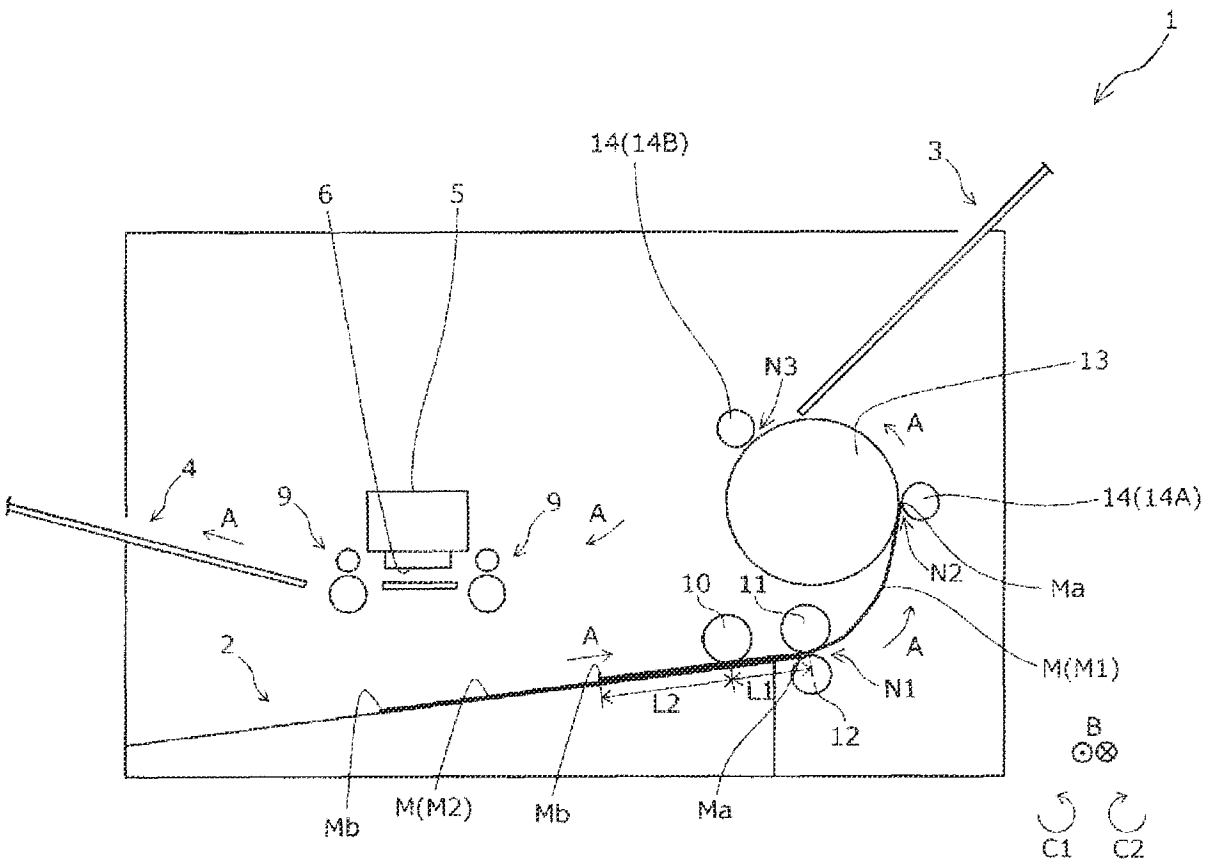
FIG. 15 is a schematic diagram showing a state in which a usable medium having a minimum length in the conveying direction is conveyed in the printer in FIG. 1, and the leading end of the medium in the conveying direction is at a nip point (a position at which conveyance can be performed) on the upstream side of an intermediate roller.

Next, a preferable length of the interruption distance formed by the sum of the gap G1, the gap G2, and the gap G3, that is, the interruption distance generated by the transmission interruption mechanism 101 will be described with reference to FIG. 15. FIG. 15 illustrates a state in which the medium M having the smallest length in the conveying direction A usable in the printer 1 according to the present embodiment is being conveyed and a state in which the leading end Ma of the medium M in the conveying direction A is at the nip point N2 of the intermediate roller 13 in accordance with the position at which the medium M can be conveyed by the intermediate roller 13. In this case, as illustrated in FIG. 15, the conveyance distance between the pickup roller 10 and the separation roller 11 is represented by L1, and the conveyance distance between the pickup roller 10 and the trailing end Mb of the medium M that has reached the position at which the medium M can be conveyed by the intermediate roller 13 is represented by L2. In addition, the peripheral speed of the intermediate roller 13 by driving the motor 8 (the conveyance speed when the medium M is conveyed by the intermediate roller 13) is X1, and the peripheral speed of the pickup roller 10 by driving the motor 8 (the conveyance speed when the medium M is conveyed by the pickup roller 10) is X2. X1/X2 which is the reduction ratio between X1 and X2 is represented by X. When defined in this manner, the interruption distance L1/X of the pickup roller 10 necessary for suppressing jamming generated by the transmission interruption mechanism 101 and the interruption distance L2−L2/X of the pickup roller 10 that can be generated by the transmission interruption mechanism 101 when the conveyance distance between the trailing end Me of the medium M that has reached the position at which conveyance can be performed by the intermediate roller 13 and the pickup roller 10 is L2 preferably satisfy formula (1) given below.

$$L1/X \leq L2-L2/X \quad (1)$$

By adopting a configuration that satisfies such a formula, it is possible to accurately convey the succeeding second medium M2 by the pickup roller 10 after the preceding first medium M1 reliably passes through the nip point N1 between the separation roller 11 and the retard roller 12. Therefore, by adopting the configuration that satisfies such a formula, it is possible to particularly effectively suppress occurrence of jamming of the second medium M2 near the nip point N1.

For example, in the present embodiment, the conveyance distance L1 is 25 mm, the usable medium M having the minimum length in the conveying direction A is L-size paper, and the conveyance distance L2 in the case of using L-size paper as the medium M is 35 mm. The peripheral speed X1 of the intermediate roller 13 is set to 500 mm/sec, and the peripheral speed X2 of the pickup roller 10 is set to 250 mm/sec. Then, the reduction ratio X between the peripheral speed X1 of the intermediate roller 13 and the peripheral speed X2 of the pickup roller 10 is 500/250, that is, 2. In this case, the interruption distance L1/X of the pickup roller 10 required to suppress jamming generated by the transmission interruption mechanism 101 is 25/2 mm, that is, 12. 5 mm. On the other hand, the actual interruption distance L2−L2/X generated by the printer 1 according to the present embodiment is 35−35/2 mm, that is, 17.5 mm. Therefore, in the present embodiment, formula (1) given above is satisfied, and the interruption distance of the pickup roller 10 which can be actually generated by the transmission interruption mechanism 101 is longer than the interruption distance of the pickup roller 10 which is necessary for suppressing jamming caused by the transmission interruption mechanism 101.

The present disclosure is not limited to each embodiment described above, many variations are possible within the scope of the present disclosure as described in the appended claims, and it goes without saying that such variations also fall within the scope of the present disclosure. For example, a plurality of members corresponding to the second rotating member 123 may be provided at the rotating shaft 120. By providing a plurality of rotating shafts 120 with members corresponding to the second rotating member 123, it is possible to increase the interruption distance generated by the transmission interruption mechanism 101. Further, for example, the present disclosure is not limited to the printer and may be applied to a conveying device in a scanner, an intermediate unit provided between various devices, a finisher, or the like.

What is claimed is:

1. A medium conveying device comprising:

an accommodation unit that accommodates a plurality of media including a first medium and a second medium conveyed subsequently to the first medium;

a pickup roller that conveys, downstream in a conveying direction, a medium accommodated in the accommodation unit;

a retard roller that is provided downstream of the pickup roller in the conveying direction and separates the medium conveyed by the pickup roller;

a separation roller that abuts on the retard roller and conveys a medium downstream in the conveying direction;

a conveyance roller that is provided downstream of the separation roller in the conveying direction and conveys a medium downstream in the conveying direction;

a drive source that generates power for rotating the pickup roller, the separation roller, and the conveyance roller;

a power transmission mechanism that transmits the power to the pickup roller and the separation roller; and a transmission interruption mechanism that is provided in the power transmission mechanism and interrupts transmission of the power to the pickup roller during transmission of the power to the separation roller, wherein the transmission interruption mechanism is configured to interrupt the transmission of the power to the pickup roller after the pickup roller conveys a trailing end of the first medium in the conveying direction.

2. The medium conveying device according to claim 1, wherein the transmission interruption mechanism is configured to interrupt the transmission of the power to the pickup roller until the separation roller conveys the trailing end of the first medium.

3. The medium conveying device according to claim 1, wherein the pickup roller includes an abutment portion, and the transmission interruption mechanism includes a rotating member that is provided at a rotating shaft of the pickup roller, is configured to rotate in a first rotating direction that is a rotating direction when a medium is conveyed with respect to the rotating shaft, includes an abutted portion configured to abut on and separate from the abutment portion and is configured to interrupt transmission of the power to the pickup roller while the rotating member rotates in the first rotating direction so as to be displaced from a state in which the abutted portion is separated from the abutment portion to a state in which the abutted portion abuts on the abutment portion.

4. The medium conveying device according to claim 3, wherein a first conveyance speed at which the medium is conveyed by the conveyance roller by driving the drive source is faster than a second conveyance speed at which the medium is conveyed by the pickup roller by driving the drive source, and when the medium is conveyed by both the conveyance roller and the pickup roller by driving the drive source, the medium is conveyed at the first conveyance speed, and the pickup roller receives a force from the medium as the medium is conveyed at the first conveyance speed so as to displace the rotating member from a state in which the abutted portion abuts on the abutment portion to a state in which the abutted portion is separated from the abutment portion.

5. The medium conveying device according to claim 4, further comprising a reception unit that receives an instruction to convey a medium, wherein the pickup roller is configured to rotate in the first rotating direction by the abutted portion in a state of abutting on the abutment portion after completion of execution of the conveyance instruction received by the reception unit.

6. The medium conveying device according to claim 5, wherein rotation of the pickup roller is continued by driving the drive source after a trailing end of a last medium to be conveyed passes through a position at which the medium is conveyable by the pickup roller after completion of execution of the conveyance instruction received by the reception unit.

7. The medium conveying device according to claim 1, $L1/X \leq L2 - L2/X$, where $L1/X$ is an interruption distance of the pickup roller generated by the transmission interruption mechanism necessary when a conveyance distance between the pickup roller and the separation roller is $L1$, a peripheral speed of the conveyance roller obtained by driving the drive source is $X1$, a peripheral speed of the pickup roller obtained by driving the drive source is $X2$, and $X1/X2$ that is a reduction ratio between $X1$ and $X2$ is $X$, and $L2 - L2/X$ is an interruption distance of the pickup roller configured to be generated by the transmission interruption mechanism when a conveyance distance between a trailing end of the medium reaching a position at which the medium is conveyable by the conveyance roller and the pickup roller is $L2$.

8. The medium conveying device according to claim 1, wherein the power transmission mechanism includes a first gear provided at a rotating shaft of the pickup roller, a second gear provided at a rotating shaft of the separation roller, and a third gear which is engaged with the first gear and the second gear and to which a driving force from the drive source is transmitted.

* * * * *